US007527484B2

(12) United States Patent
Kim et al.

(10) Patent No.: US 7,527,484 B2
(45) Date of Patent: May 5, 2009

(54) MUFFLER OF SCROLL COMPRESSOR

(75) Inventors: Seung-yup Kim, Suwon-si (KR); Hyo-keun Park, Suwon-si (KR); Dong-soo Lee, Seoul (KR); Jeong-hwan Suh, Seongnam-si (KR)

(73) Assignee: LG Electronics Inc., Seoul (KR)

( * ) Notice: Subject to any disclaimer, the term of this patent is extended or adjusted under 35 U.S.C. 154(b) by 221 days.

(21) Appl. No.: 11/428,849

(22) Filed: Jul. 6, 2006

(65) Prior Publication Data

US 2008/0008612 A1 Jan. 10, 2008

(51) Int. Cl.
*F01C 1/02* (2006.01)
*F03C 2/00* (2006.01)
*F04C 18/00* (2006.01)

(52) U.S. Cl. ..... 418/55.1; 418/55.6; 418/94; 418/97; 418/181; 181/225; 181/272

(58) Field of Classification Search ..... 418/55.1–55.6, 418/57, 94, 97, 102, 181, 270, DIG. 1; 181/225, 181/272
See application file for complete search history.

(56) References Cited

U.S. PATENT DOCUMENTS 5,591,018 A * 1/1997 Takeuchi et al. ..... 418/94
6,062,834 A * 5/2000 Masumoto et al. ..... 418/55.6
2006/0057012 A1* 3/2006 Park et al. ..... 418/55.1
2006/0222550 A1* 10/2006 Shin et al. ..... 418/55.6

FOREIGN PATENT DOCUMENTS

JP 08326668 A * 12/1996
JP 2004316591 A * 11/2004

* cited by examiner

*Primary Examiner*—Theresa Trieu
(74) *Attorney, Agent, or Firm*—Greenblum & Bernstein, P.L.C.

(57) ABSTRACT

Disclosed herein is a muffler of a scroll compressor. The muffler includes a first muffler having a pair of chambers defined above an outlet of a fixed scroll to communicate with the outlet and a gas passage hole formed at the center of an upper end thereof, and a second muffler located around the first muffler to be spaced apart from the gas passage hole of the first muffler and having a chamber including one or more guidance paths of the fixed scroll. The muffler can achieve reduction of operational noise, sufficient separation of oil contained in discharge gas, and efficient isolation between a discharge pressure inside the muffler and outside suction pressure.

12 Claims, 5 Drawing Sheets

MUFFLER OF SCROLL COMPRESSOR

BACKGROUND OF THE INVENTION

1. Field of the Invention

The present invention relates to a muffler of a scroll compressor, and more particularly, to a muffler of a scroll compressor, which can achieve: reduction of operational noise; sufficient separation of oil contained in discharge gas; and efficient isolation between a discharge pressure inside the muffler and outside suction pressure.

2. Description of the Related Art

A general scroll compressor, as shown in FIG. 1, includes a main frame 2 and sub frame 3 mounted in a shell 1 at upper and lower locations of the shell 1, a stator 4 press-fitted in the shell 1 between the main frame 2 and the sub frame 3, and a rotor 5 disposed in the stator 4 and adapted to rotate by power applied thereto.

A vertical crank shaft 6 is fixedly inserted into the center of the rotor 5 such that opposite ends thereof are rotatably supported by the main frame 2 and sub frame 3, respectively. Then, the vertical crank shaft 6 is rotated along with the rotor 5.

The scroll compressor further includes a compression unit including an orbiting scroll 7 disposed on an upper end surface of the main frame 2, and a fixed scroll 8 located over the orbiting scroll 7 to be secured to an inner periphery of the shell 1. The orbiting scroll 7 has a lower portion coupled to the crank shaft 6 and an upper portion forming an involute orbiting wrap 7*a*. The fixed scroll 8 has a fixed wrap 8*a* configured to be engaged with the orbiting wrap 7*a* in such a manner that a compression chamber 21 is defined between the fixed wrap 8*a* and the orbiting wrap 7*a*. With this configuration, while the orbiting scroll 7 performs an orbiting rotation by rotation of the crank shaft 6, refrigerant gas introduced into the compression chamber 21 can be compressed.

A structure for coupling the crank shaft 6 with the orbiting scroll 7 includes a hollow boss 7*b*, which protrudes downward from the center of a lower portion of the orbiting scroll 7, and a crank pin 10 which protrudes upward from the center of an upper end surface of the crank shaft 6 by a predetermined distance to be inserted into the hollow boss 7*b*. A bearing 11 is forcibly press-fitted in the boss 7*b*, and an eccentric bush 12 is rotatably coupled around the crank pin 10.

In addition, an Oldham's ring 9 serving as anti-rotation device is interposed between the main frame 2 and the orbiting scroll 7. An oil supply path 6*a* is vertically defined in the crank shaft 6 throughout the overall length of the crank shaft 6. A pair of upper and lower balancing weights 13 and 14 are arranged above and below the rotor 51 respectively, to prevent unbalanced rotation of the crank shaft 6 that may be caused by the crank pin 10.

If high-pressure refrigerant gas compressed in the above described compression unit is discharged through an outlet 17 of the fixed scroll 8, the high-pressure refrigerant gas imparts a direct shock to a top cap la constituting an upper end of the shell 1, thus causing generation of noise. Accordingly, to reduce the noise, a muffler 22 is mounted above the fixed scroll 8. The muffler 22, as shown in FIG. 2, takes the form of a cover.

In addition to this noise reduction function, the muffler 22 has a function of isolating a suction pressure from a discharge pressure, namely, a low-pressure portion from a high pressure portion when the scroll compressor has a high-pressure structure wherein a lower region of the compressor is filled with the high-pressure refrigerant gas discharged from the compression unit. The fixed scroll 8 has guidance paths 23 to guide the compressed refrigerant gas in the muffler 22 into the lower region of the compressor.

In FIG. 1, reference numerals 15 and 16 designate a suction pipe and discharge pipe, respectively, and reference numeral 18 designates a discharge chamber. Also, reference numerals 19 and 20 designate oil and an oil propeller, respectively.

In the scroll compressor having the above described configuration, if the rotor 5 rotates in the stator 4 upon receiving power, the crank shaft 6 is rotated by the rotor 5, thus causing the orbiting scroll 7, which is coupled to the crank shaft 6 by use of the crank pin 10, to perform an orbiting movement along an orbiting radius between the center of the crank shaft 6 and the center of the orbiting scroll 7.

Accordingly, the compression chamber 21, which is defined between the orbiting wrap 7*a* and the fixed wrap 8*a*, has a volume reduction by continuous orbiting movement of the orbiting scroll 7, resulting in compression of refrigerant gas suctioned thereinto. The compressed high-pressure refrigerant gas is discharged into the discharge chamber 18 through the outlet 17 of the fixed scroll 8. In turn, the refrigerant gas in the discharge chamber 18 is guided into the lower region of the compressor through the guidance paths 23 of the fixed scroll B, and thereafter, is discharged to the outside through the discharge pipe 16.

Generally, in the course of discharging the high-pressure refrigerant gas compressed in the compression unit through the outlet 17 of the fixed scroll 8, the high-pressure refrigerant imparts a direct shock to the top cap la of the shell 1, resulting in generation of noise. Accordingly, to reduce the noise, the muffler 22, which takes the form of a cover as shown in FIG. 2, is mounted on the fixed scroll 8.

As stated above, the muffler 22 functions to reduce noise and also, to isolate a suction pressure from a discharge pressure, namely, a low-pressure portion from a high pressure portion when the scroll compressor has a high-pressure structure wherein the lower region of the compressor is filled with the high-pressure refrigerant gas discharged from the compression unit. To guide the compressed refrigerant gas in the muffler 22 into the lower region of the compressor, the guidance paths 23 are defined in the fixed scroll 8.

However, the above described conventional muffler for use with the scroll compressor has an unsophisticated cover structure simply defining a single shield wall, and therefore, cannot achieve a sufficient noise transmission loss (TL). Further, the conventional muffler has no function of sufficiently separating oil contained the high-pressure refrigerant gas discharged from the outlet of the fixed scroll. Furthermore, the conventional muffler cannot achieve an accurate isolation between a discharge pressure inside the muffler and outside suction pressure. For these several problems, the above described conventional muffler has been proved to cause deterioration in the performance and reliability of scroll compressors.

SUMMARY OF THE INVENTION

Therefore, the present invention has been made in view of the above problems, and it is an object of the present invention to provide a muffler of a scroll compressor, which can prevent high-pressure refrigerant gas, which is compressed in a compression unit, from imparting a direct shock to a top cap of a compressor shell in the course of being discharged through an outlet of a fixed scroll, thereby achieving a sufficient noise transmission loss.

It is another object of the present invention to provide a muffler of a scroll compressor which can achieve not only sufficient separation of oil contained in discharge gas, but also very accurate isolation between a discharge pressure inside the muffler and outside suction pressure.

In accordance with the present invention, the above and other objects can be accomplished by the provision of a muffler of a scroll compressor comprising: a first muffler having a pair of chambers defined above an outlet of a fixed scroll to communicate with the outlet and a gas passage hole formed at the center of an upper end thereof; and a second muffler located around the first muffler to be spaced apart from the gas passage hole of the first muffler and having a chamber communicating with one or more guidance paths of the fixed scroll.

Preferably, the chambers of the first muffler may include a lower first chamber and an upper second chamber.

Preferably, the second chamber may be defined by an inclined conical wall.

Preferably, the inclined conical wall may have pleats.

Preferably, the second muffler may be defined by a planar gas confronting wall forming the center of a top thereof and a curved wall extending downward from the planar gas confronting wall to have a gentle curvature.

Preferably, the curved wall may have pleats.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
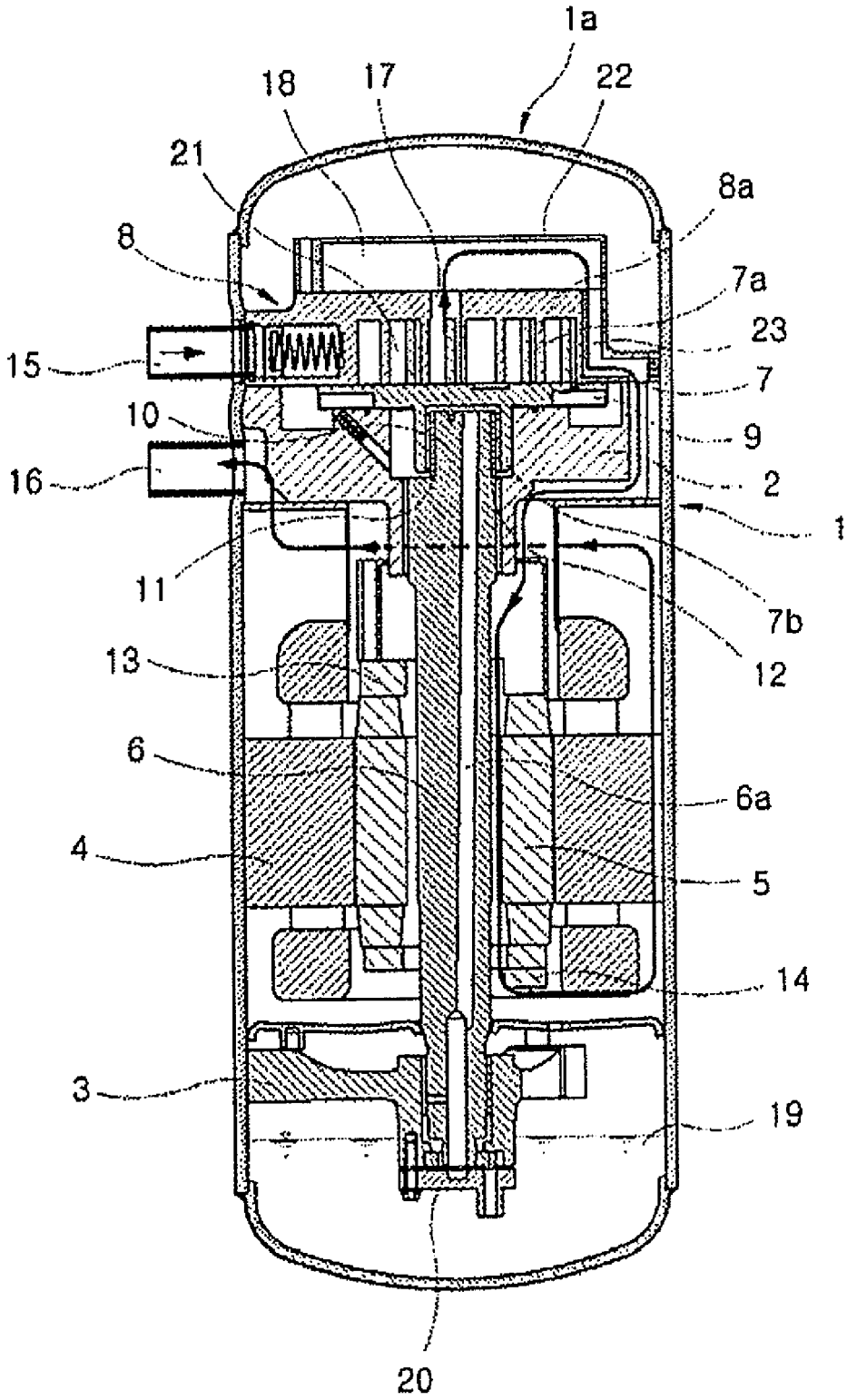
FIG. 1 is a longitudinal sectional view illustrating the inner configuration of a general scroll compressor.
Figure 2:
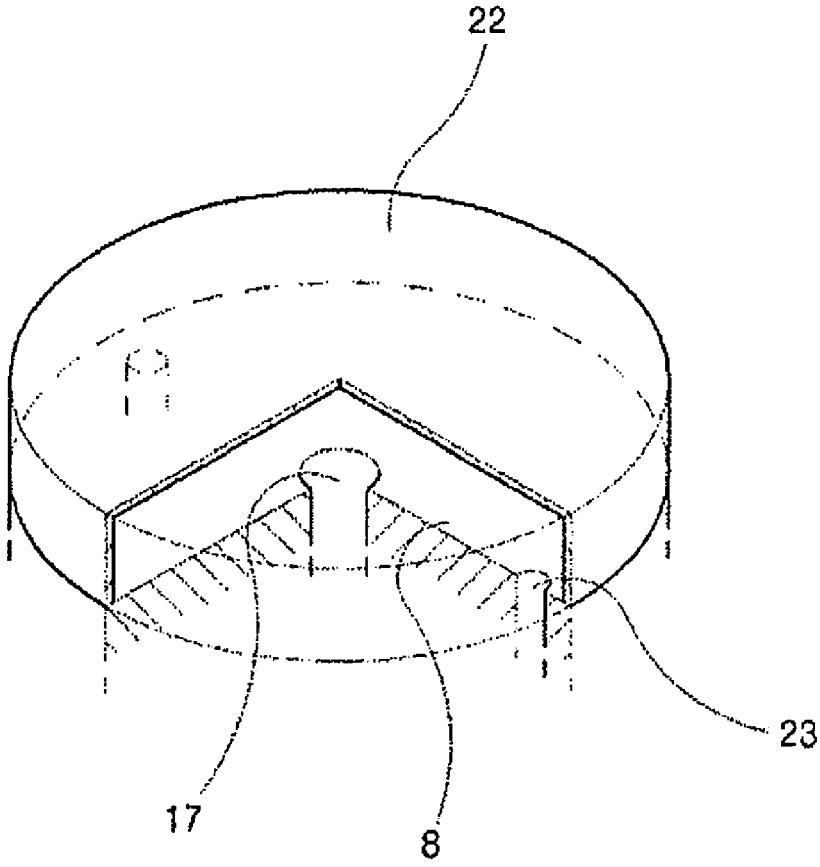
FIG. 2 is a semi-sectional perspective view illustrating the configuration of a conventional muffler included in the general scroll compressor.

Now, the configuration of the present invention will be explained in detail with reference to the accompanying drawings.

In the following description, the constituent elements of the present invention respectively corresponding to those of the prior art are designated by the same reference numerals.

Figure 3:
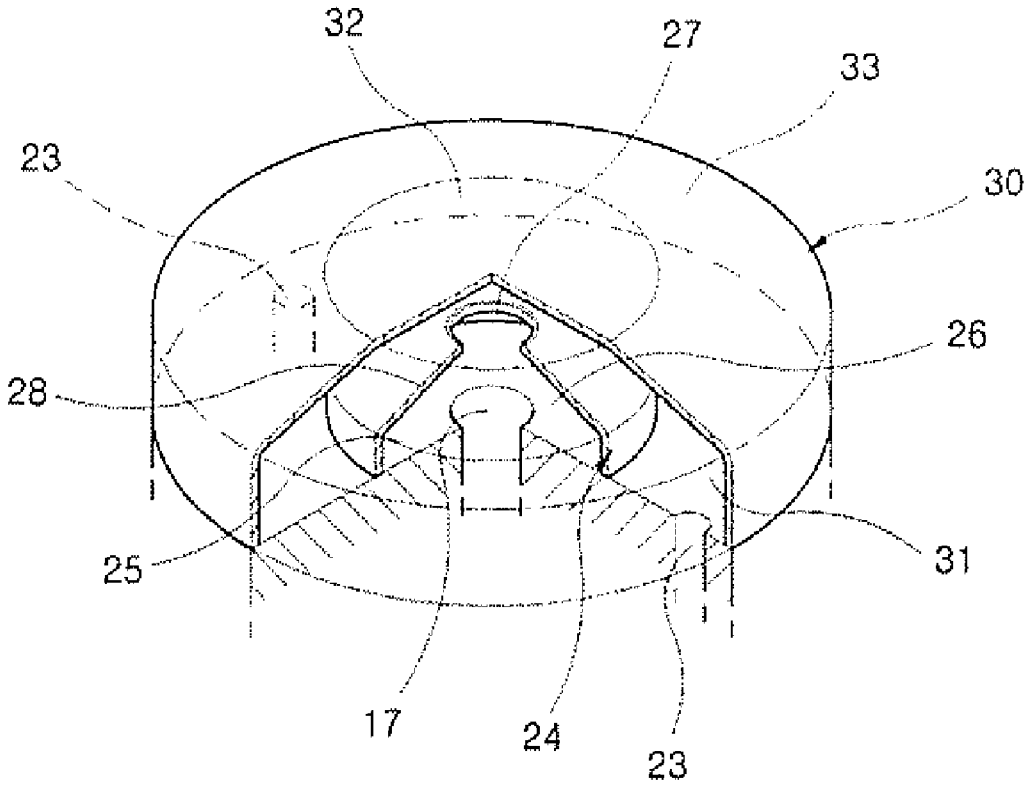
FIG. 3 is a semi-sectional perspective view illustrating a muffler according to a first embodiment of the present invention.

Referring to FIG. 3 illustrating a muffler according to a first embodiment of the present invention in semi-sectional perspective view, the muffler includes a first muffler 24 and a second muffler 30. The first muffler 24 internally defines a pair of chambers above the outlet 17 of the fixed scroll 8 to communicate with the outlet 17, and is formed with a gas passage hole 27 at the center of an upper end thereof. The second muffler 30 is located around the first muffler 24 to be spaced apart from the gas passage hole 27 of the first muffler 24. The second muffler 30 internally defines a chamber, i.e. third chamber 31, including the guidance paths 23 of the fixed scroll 8.

The chambers of the first muffler 24 include a lower first chamber 25 and upper second chamber 26. The second chamber 26 is defined by an inclined conical wall 28.

The second muffler 30 has a planar gas confronting wall 32 forming the center of a top thereof, and a curved wall 33 extending downward from the planar gas confronting wall 32 to have a gentle curvature.

Figure 4:
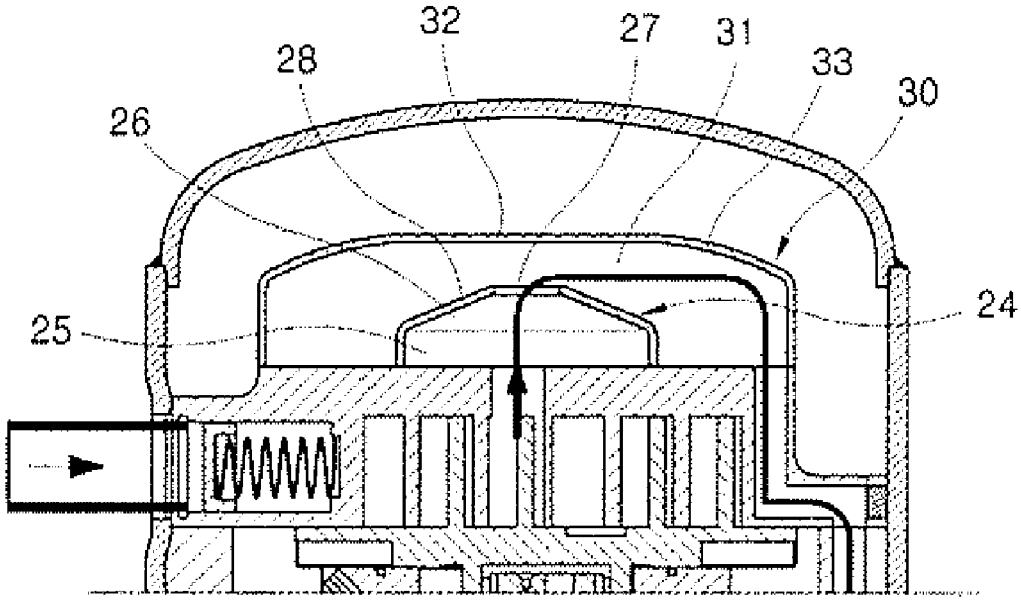
FIG. 4 is a partially-enlarged sectional view illustrating the muffler of FIG. 3 after being mounted in a scroll compressor.

In the muffler of the present embodiment having the above described configuration, as shown in FIG. 4, if compressed high-pressure refrigerant gas is discharged through the outlet 17 of the fixed scroll 8, the high-pressure refrigerant gas first circulates the first and second chambers 25 and 26 of the first muffler 24 in this sequence, and then, is introduced into the second muffler 30 through the gas passage hole 27 of the second chamber 26, so as to circulate in the second muffler 30. In this case, as the refrigerant gas, which circulates in the first and second chambers 25 and 26, comes into contact with the inclined wall 28 of the second chamber 26, which is conically extended upward from the vertical wall of the first chamber 25, oil contained in the refrigerant gas is able to be separated.

Then, the gas, which is discharged from the gas passage hole 27 of the second chamber 26 to be introduced into the second muffler 30, circulates from the approximately circular planar gas confronting wall 32, which forms the center of the top of the second muffler 30, toward the bottom of the second muffler 30 along the circumferential curved wall 33, and thereafter, is guided into the lower region of the compressor through the guidance paths 23 of the fixed scroll 8. While circulating in the second muffler 30, similarly, the refrigerant gas is subjected to a secondary oil separation via contact with the wall of the second muffler 30. In addition to these primary and secondary oil separations, the double structure muffler of the present invention has the effect of achieving an outstanding noise transmission loss.

Figure 5:
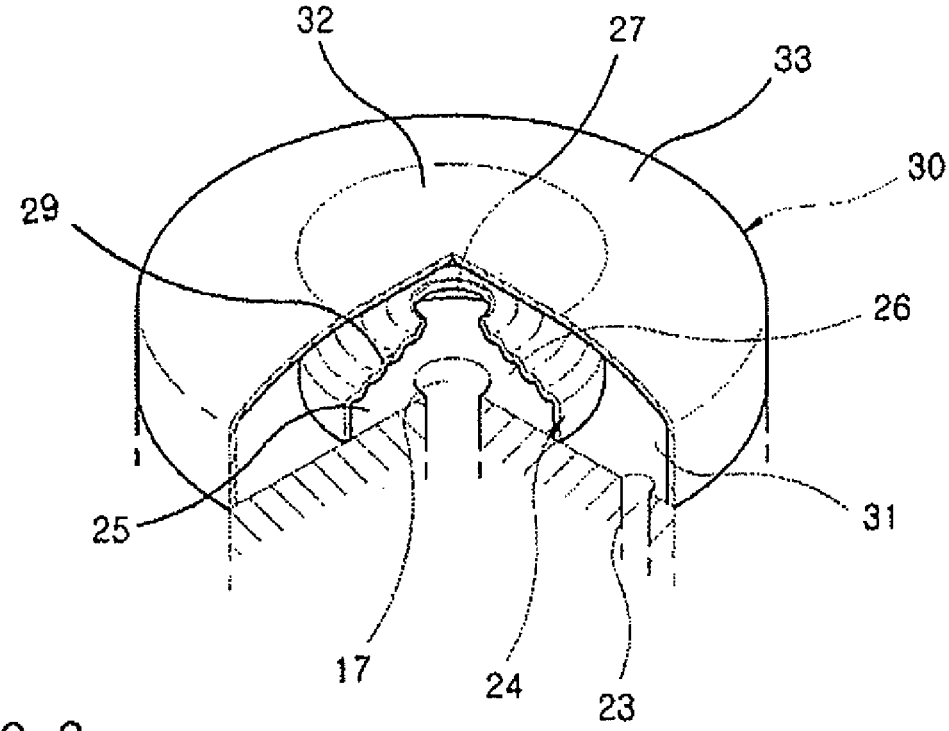
FIG. 5 is a semi-sectional perspective view illustrating a muffler according to a second embodiment of the present invention.

FIG. 5 is a semi-sectional perspective view illustrating a muffler according to a second embodiment of the present invention.

As shown in FIG. 5, similar to the previously described first embodiment of the present invention, the muffler of the present embodiment includes the first muffler 24 and second muffler 30. The first muffler 24 internally defines the pair of chambers above the outlet 17 of the fixed scroll 8 to communicate with the outlet 17, and is formed with the gas passage hole 27 at the center of the upper end thereof. The second muffler 30 is located around the first muffler 24 to be spaced apart from the gas passage hole 27 of the first muffler 24, and internally defines the third chamber 31 including the guidance paths 23 of the fixed scroll 8.

The chambers of the first muffler 24 include the lower first chamber 25 and upper second chamber 26, and in particular, the second chamber 26 is defined by the inclined conical wall 28.

The second muffler 30 has the planar gas confronting wall 32 forming the center of the top thereof, and the curved wall 33 extending downward from the planar gas confronting wall 32 to have a gentle curvature. Here, in a differential feature of the present embodiment, the inclined conical wall 28 of the first muffler 24 has pleats 29.

As the pleats 29 are formed at the inclined conical wall 28 of the second chamber 26, a contact area between the wall 28 and the refrigerant gas increases, resulting in improved oil separation efficiency.

Figure 6:
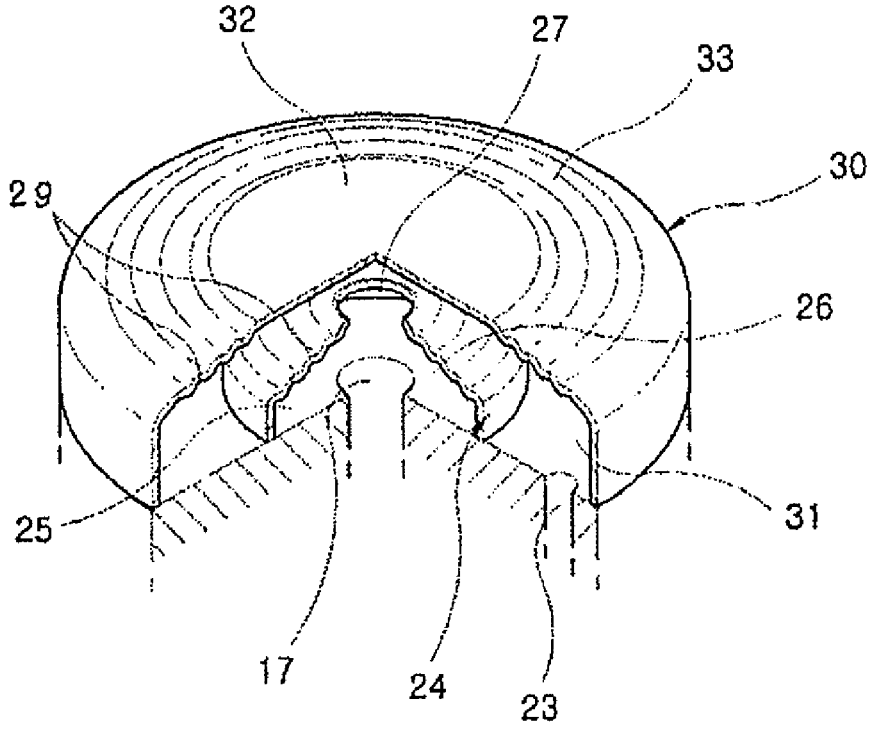
FIG. 6 is a semi-sectional perspective view illustrating a muffler according to a third embodiment of the present invention.

FIG. 6 is a semi-sectional perspective view illustrating a muffler according to a third embodiment of the present invention.

As shown in FIG. 6, similar to the previously described first and second embodiments of the present invention, the muffler of the present embodiment includes the first muffler 24 and second muffler 30. The first muffler 24 internally defines the pair of chambers above the outlet 17 of the fixed scroll 8 to communicate with the outlet 17, and is formed with the gas passage hole 27 at the center of the upper end thereof. The second muffler 30 is located around the first muffler 24 to be spaced apart from the gas passage hole 27 of the first muffler 24, and internally defines the third chamber 31 including the guidance paths 23 of the fixed scroll 8.

The chambers of the first muffler 24 include the lower first chamber 25 and upper second chamber 26, and in particular, the second chamber 26 is defined by the inclined conical wall 28.

The second muffler 30 has the planar gas confronting wall 32 forming the center of the top thereof, and the curved wall 33 extending downward from the planar gas confronting wall 32 to have a gentle curvature. Here, in a differential feature of the present embodiment, both the inclined conical wall 28 of the first muffler 24 and the curved wall 33 of the second muffler 30 have the pleats 29.

As the pleats 29 are formed at the inclined conical wall 28 of the second chamber 26 and the curved wall 33 of the second muffler 30, in the same manner as the second embodiment of the present invention, a contact area between the walls 28 and 33 and the refrigerant gas increases, resulting in more improved oil separation efficiency. Furthermore, the curved wall 33 of the second muffler 30 having the pleats 29 has the effect of providing the planar gas confronting wall 32, onto which the compressed refrigerant gas discharged through the gas passage hole 27 of the second chamber 26 imparts a direct shock, with shock-alleviating effect.

As apparent from the above description, the present invention provides a muffler of a scroll compressor, which has a double muffler structure internally defining three chambers. With this double muffler structure, it is possible not only to achieve a sufficient transmission loss of noise generated when compressed high-pressure refrigerant gas is discharged through an outlet of a fixed scroll, but also to achieve sufficient separation of oil contained in the gas. Further, the muffler of the present invention has the effect of isolating a discharge pressure inside the muffler from an outside suction pressure with increased accuracy, resulting in an improvement in the performance and reliability of compressors.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A muffler of a scroll compressor comprising:

a first muffler having a lower first chamber and an upper second chamber, each defined above an outlet of a fixed scroll to communicate with the outlet and a gas passage hole formed at the center of an upper end thereof, wherein the second chamber is defined by an inclined conical wall, and wherein the inclined conical wall has pleats; and a second muffler located around the first muffler to be spaced apart from the gas passage hole of the first muffler and having a chamber communicating with one or more guidance paths of the fixed scroll.

2. The muffler according to claim 1, wherein the second muffler is defined by a planar gas confronting wall forming the center of a top thereof and a curved wall extending downward from the planar gas confronting wall to have a gentle curvature.

3. The muffler according to claim 2, wherein the curved wall has pleats.

4. A scroll compressor comprising:

a main frame and sub frame mounted in a shell at upper and lower locations of the shell;

an orbiting scroll disposed on an upper end surface of the main frame and coupled with a crank shaft that is rotated by a drive unit;

a fixed scroll arranged above the orbiting scroll and having a fixed wrap to be engaged with an orbiting wrap included in the orbiting scroll;

a first muffler arranged above an outlet of the fixed scroll and having a gas passage hole, a lower first chamber and an upper second chamber, wherein the second chamber is defined by an inclined conical wall having pleats; and a second muffler arranged around the first muffler to be spaced apart from the first muffler and having a chamber including one or more guidance paths defined in the fixed scroll.

5. The compressor according to claim 4, wherein the second muffler is defined by a gas confronting wall and a curved wall extending downward from the planar gas confronting wall to have a gentle curvature.

6. The compressor according to claim 5, wherein the curved wall has pleats.

7. The compressor according to claim 4, further comprising:

a stator press-fitted in the shell at a position between the main frame and the sub frame; and a rotor arranged in the stator and adapted to rotate by power applied thereto.

8. The compressor according to claim 7, wherein the crank shaft is inserted through the center of the rotor in such a manner that opposite ends thereof are rotatably supported by the main frame and sub frame, respectively.

9. The compressor according to claim 8, wherein a crank pin is eccentrically formed at the upper end of the crank shaft to be coupled to a boss formed at the center of a lower portion of the orbiting scroll.

10. The compressor according to claim 9, wherein an oil supply path is vertically penetrated in the crank shaft.

11. The compressor according to claim 4, wherein the orbiting wrap and fixed wrap define a compression chamber therebetween, and the fixed scroll has an outlet to discharge refrigerant gas compressed in the compression chamber.

12. The compressor according to claim 11, wherein the fixed scroll has one or more guidance paths to guide the refrigerant gas, discharged from the mufflers, into a lower region of the compressor.

* * * * *